US011407547B2

(12) United States Patent
Tautz et al.

(10) Patent No.: US 11,407,547 B2
(45) Date of Patent: Aug. 9, 2022

(54) LABELLING DEVICE WITH SLIDE ASSEMBLY

(71) Applicant: Multivac Marking & Inspection GmbH & Co. KG, Enger (DE)

(72) Inventors: Frank Tautz, Rahden (DE); Simon Schmidt, Bielefeld (DE); Mathias Krause, Spenge (DE); Andreas Bußmann, Enger (DE)

(73) Assignee: MULTIVAC MARKIMG & INSPECTION GMBH & CO. KG, Enger (DE)

( * ) Notice: Subject to any disclaimer, the term of this patent is extended or adjusted under 35 U.S.C. 154(b) by 296 days.

(21) Appl. No.: 16/210,263

(22) Filed: Dec. 5, 2018

(65) Prior Publication Data

US 2019/0177027 A1 Jun. 13, 2019

(30) Foreign Application Priority Data

Dec. 8, 2017 (EP) ..... 17206202

(51) Int. Cl.
*B65C 1/02* (2006.01)
*B65C 9/36* (2006.01)
(Continued)

(52) U.S. Cl.
CPC ..... *B65C 1/021* (2013.01); *B65C 9/0006* (2013.01); *B65C 9/1884* (2013.01); *B65C 9/1892* (2013.01); *B65C 9/36* (2013.01)

(58) Field of Classification Search
CPC ..... B65C 1/021; B65C 9/1884; B65C 9/0006; B65C 9/1892; B65C 9/36; B65C 9/18
(Continued)

(56) References Cited

U.S. PATENT DOCUMENTS 3,721,352 A * 3/1973 Messmer ..... B65C 9/36 414/627
4,261,783 A * 4/1981 Finke ..... B65C 11/004 156/384
(Continued)

FOREIGN PATENT DOCUMENTS

CN 101691665 A 4/2010
CN 206466306 U 9/2017
(Continued)

OTHER PUBLICATIONS

European Search Report and Opinion dated Jun. 19, 2018, Application No. 17206202.8-1017, Applicant Multivac Marking & Inspection GMBH & Co. KG, 6 Pages.
(Continued)

*Primary Examiner* — Robert F Long
*Assistant Examiner* — Eduardo R Ferrero
(74) *Attorney, Agent, or Firm* — Brooks Kushman P.C.

(57) ABSTRACT

A labelling device having a label dispenser and transfer device for transferring a row of labels delivered to the transfer device to an article web. The transfer device may include at least one vertically adjustable slide assembly mounted thereon for pressing the labels onto the article web, and the slide assembly may comprise a base plate and a plurality of pressing elements. The slide assembly may further comprise at least one cassette module assembled with the base plate, and one or more of the pressing elements may be arranged on each of the cassette modules.

18 Claims, 8 Drawing Sheets

(51) Int. Cl.
*B65C 9/18* (2006.01)
*B65C 9/00* (2006.01)

(58) Field of Classification Search
USPC ..... 156/542
See application file for complete search history.

(56) References Cited

U.S. PATENT DOCUMENTS 4,680,082 A * 7/1987 Kearney ..... B65C 9/1876 156/497
4,725,327 A * 2/1988 Matuda ..... B65C 1/021 156/351
5,300,181 A * 4/1994 Yamaguchi ..... B65C 1/042 156/542
5,370,754 A * 12/1994 Soloman ..... B65C 1/045 156/361
6,009,926 A * 1/2000 Vicktorius ..... B65C 9/1884 156/556
7,318,877 B2 * 1/2008 Harte ..... B65C 9/1884 156/235
9,073,657 B2 7/2015 Austermeier et al.
10,000,308 B1 * 6/2018 Kelso ..... B65C 9/26
2002/0043345 A1 4/2002 Simon
2004/0250960 A1 * 12/2004 Harte ..... B65C 9/1884 156/556
2009/0199961 A1 * 8/2009 Georg ..... B65C 9/1876 156/230
2013/0312367 A1 * 11/2013 Wolff ..... B65C 9/36 53/411
2015/0246743 A1 * 9/2015 Beck ..... B65C 1/021 156/227
2017/0225819 A1 * 8/2017 Hirata ..... B65C 9/42
2018/0305062 A1 * 10/2018 Wolff ..... B65C 9/36

FOREIGN PATENT DOCUMENTS

DE 10 2006 047 488 A1 4/2008
EP 1177982 A1 2/2002
EP 2 666 728 B1 12/2016
WO 2017102642 A1 6/2017

OTHER PUBLICATIONS

Chinese First Office Action dated Jul. 3, 2020 (with English Translation), Application No. 201811496821.3, Applicant Multivac Marking & Inspection GMBH & Co. KG, 18 Pages.

* cited by examiner

LABELLING DEVICE WITH SLIDE ASSEMBLY

CROSS-REFERENCE TO RELATED APPLICATIONS

This Application claims priority to European Patent Application No. 17206202.8 filed on Dec. 8, 2017 to Frank Tautz, Simon Schmidt, Mathias Krause and Andreas Bußmann, currently pending, the entire disclosure of which is incorporated herein by reference.

FIELD OF THE INVENTION

The present invention relates to a labelling device for packaging machines.

BACKGROUND OF THE INVENTION

A labelling device is known from EP 2 666 728 B1 to apply a series of labels to a film web. The labelling device is arranged on a thermoforming packaging machine downstream a sealing station. Essentially, the labelling device has a label dispenser and a transfer device to which labels are fed in a row using the label dispenser. The transfer device is designed to move the labels it picks up to a predetermined position above an article web provided below, comprising several sealed packages positioned next to each other, in order to then press the labels onto the lid film of the respective packages. For this purpose, the transfer device has a large number of pin slide plates which are vertically adjustably mounted using a lifting device in order to press the labels firmly onto the lid film.

The known pin slide plates have an integral design. A base plate with a one-piece plate design is used for this purpose, to which a plurality of spring-loaded pressing pins are attached. To accommodate the large number of pressing pins, the base plate contains a corresponding number of receiving openings. These can only be formed in the base plate with great manufacturing effort. In addition, only certain materials can be used to manufacture the base plate.

Another disadvantage of the known pin slide plates is that their assembly, in particular the assembly of the pressing pins, which consist of several individual small parts, has proved to be extremely difficult and time-consuming. In addition, the one-piece base plates take up quite a lot of storage space. In addition, base plates of different sizes have been produced up to now, which has resulted in a large variety of variants with increasing storage costs. Since the manufacturing materials suitable for the base plate are rather cost-intensive, the manufacturing costs of the base plates are strongly dependent on their size.

DE 10 2006 047 488 A1 discloses a labelling device with a placement casing that has several pressing stamps for applying labels to a film web.

SUMMARY OF THE INVENTION

The object of the invention is to improve a labelling device as described above with regard to the disadvantages associated with the state of the art.

The labelling device according to the invention may comprise a label dispenser and a transfer device for transferring a series of labels dispensed to the transfer device to an article web. The transfer device may comprise at least one vertically adjustably mounted slide assembly for pressing the labels onto the article web, the slide assembly comprising a base plate and a plurality of pressing elements. In accordance with the invention, the slide assembly may further comprise at least one cassette module assembled with the base plate, on each of which one or more of the pressing elements are arranged.

In the invention, the slide assembly may have a modular design, the respective pressing elements being attached to the base plate of the slide assembly by means of the cassette module designed to receive them. As a result, the base plate may be much easier to manufacture because the respective pressing elements are no longer arranged directly on the base plate but on the cassette module(s). The cassette module as such can be manufactured easily and cost-effectively with regard to its attachment to the base plate and the mounting of the respective pressing elements, thus creating additional savings potential for the manufacturing process.

In the invention, the cassette module may form a carrier unit for one or more pressing elements. As a result, the base plate design may be independent of the design of the pressing elements, which means that the base plate can be manufactured as a cost-optimized basic component and its design can be considered as a standard for several applications. This allows both the pure manufacturing costs of the base plate and the associated storage costs to be reduced.

All in all, the modular design of the slide assembly offers considerable advantages in the assembly and manufacturing process compared to an integral design. In particular, the pressing pins no longer need to be mounted individually on the base plate. Rather, the cassette module allows several pressing pins, which may be preferably already pre-assembled on the cassette module, to be attached to the base plate in a few simple steps or automatically.

In addition, the modular slide assembly may be better suited for service and cleaning applications. Against this background, different materials can be used, especially for the respective modules, which are ideally suited for production and purpose and meet the highest hygienic standards.

Preferably, the base plate and the cassette module are built together along one module level. When assembled, the base plate and the cassette module(s) attached to it may be in the form of a modular slide plate. A defined interface may be preferably formed between the base plate and the cassette module, which arranges the base plate and the cassette module in a form and/or force fit in combination with each other. The advantage of this is that the defined interface between the base plate and the cassette module can be designed to be simple, excellent for uncomplicated and, if necessary, automated module assembly, e.g. in the form of edges that simply lie in a straight line against each other.

It may be useful if the pressing element is pre-tensioned by means of a spring into a disengaged first position on the cassette module. The spring-loaded bearing of the pressing element ensures that it can be pushed from the first position to a second, indented position on the cassette module during a pressing process for applying the labels, so that a maximum permissible pressure force for applying the labels to the film web may be not exceeded.

According to one variant, the cassette module may be detachably connected to the base plate. With this design, the cassette module can be removed from the base plate, in particular for a cleaning process, for example tool-less/manually or by means of a tool insert. This variant may be particularly interesting if it is foreseen that the cassette module(s) will be replaced when a predetermined number of operating hours are reached, i.e. if the slide assembly needs to be replaced.

Preferably, the cassette module may be fixed to the base plate by means of a coupling element. The coupling element may be primarily designed to hold the base plate and the cassette module together along the defined interface. Preferably, the coupling element may be made of the same material as the cassette module. The coupling element may consist of a pair of connector straps or bars that can be connected together at their respective ends. Preferably, the connector straps or bars are formed and interconnected such that they are attachable at least in sections to opposite outer sides of the base plate to connect the cassette module to the base plate.

In accordance with an advantageous embodiment, the coupling element may be dimensioned in such a way that it can be used to guide the slide assembly along a guide plane. In addition to its actual connector function, the coupling element can also be used as a guide component. The coupling element can thus perform a dual function by being used both for fixing the cassette module to the base plate and as a guide for the slide assembly.

It would be useful for the guiding function if a surface section formed by the coupling element was at least partially coplanar with a surface formed by the cassette module. This would allow an effectively usable guide surface for the slide valve assembly to be further enlarged in terms of the guide level, which would make it possible to produce a particularly stable and accurate guide, particularly suitable for continuous operation.

As an alternative to a manually detachable coupling of the cassette module to the base plate without the use of additional tools, the assembly could also be so rigid that the cassette module can only be dismantled from the base plate using specially designed tools, if necessary by machine. This can result in advantages with regard to a stable assembly of the slide assembly.

For a cleaning process, the entire slide assembly could be removed from the transfer device and fed to an immersion bath, according to one variant. The removal of the slide assembly, its cleaning in the immersion bath and the reassembly of the slide assembly can be carried out within a short time frame.

An advantageous embodiment provides that the cassette module may comprise at least one first receptacle, wherein the coupling element may be fastened in such a way that at least in sections an outside of the coupling element together with an outside of the cassette module lie within the guide plane, i.e. merge into one another without protrusion. This allows the coupling element to be attached to the cassette module in a particularly space-saving and inconspicuous manner. Furthermore, there may be an enlarged guide surface for the slide assembly and, in particular, there are fewer points for potential deposit of impurities.

Preferably the cassette module, for example on a side facing away from the base plate, may comprise at least one second receptacle in which at least one connector element may be fastened in order to secure the or several pressing elements to the cassette module. For this purpose, the connector element extends within the second receiving preferably over the entire width of the cassette module. Further, the connector element may be dimensioned such that an outer surface thereof may be planar with at least a portion of the outer surface of the cassette module when the connector element may be secured in the second receptacle. This makes the cassette module compact and particularly suitable for hygienic operation.

A plurality of connector elements can also be fastened in the second receptacle. The connector elements are preferably fixed one above the other in the second receptacle, wherein the connector elements are arranged laterally offset from one another within the module plane, and wherein one of the connector elements projects beyond a side edge of the cassette module in order to be fastened to another cassette module. This allows cassette modules arranged side by side on the base plate to be attached to each other.

According to one variant, the pressing element may be designed in several parts. The pressing element can be configured as a spring-loaded slide pin. The pressing element preferably may comprise a journal, a pin and a pressing piece fastened to one end of the pin protruding from the cassette module, for example a plastic cap for pressing on the labels.

A plurality of cassette modules may be preferably mounted side by side on the base plate. The respective cassette modules can be configured to accommodate a variety of pressing elements, preferably two or four. A particularly advantageous embodiment provides that a cassette module designed to accommodate two pressing elements can be produced from a cassette module designed to accommodate four pressing elements, for example by a separation process.

The cassette module can be manufactured particularly cost-effectively if it is made of plastic. The cassette module is preferably an injection-moulded part. According to a variant, the coupling element and/or the connector element are also manufactured as injection moulded parts, preferably from the same plastic as the cassette module.

The cassette module, the coupling element and/or the connector element are preferably made of polyamide (PA) or polyoxymethylene (POM). Due to their high strength and toughness, these materials are particularly well suited as construction materials for their intended use in the invention.

According to one variant, the base plate may be made of hard paper. The hard paper may be preferably made of paper as carrier material and phenol/formaldehyde resin as binding agent. For example, a HP 2061.9 hard paper could be used. Preferably, the base plate may be made of a phenolic or melamine coated hard paper. This allows the mechanical properties of the base plate to be further improved. In addition, such coated base plates are ideal for cleaning processes.

As already mentioned, the cassette module can be designed to accommodate at least two or four pressing elements. In particular, the cassette module can be a pre-assembly module, i.e. the respective pressing elements are already mounted on it before the cassette module and the pressing elements secured to it are attached to the base plate. The respective pressing elements can therefore be quickly attached to and removed from the base plate.

The labelling device according to the invention can be used particularly advantageously on a packaging machine in the form of a thermoforming packaging machine or a tray sealer.

Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
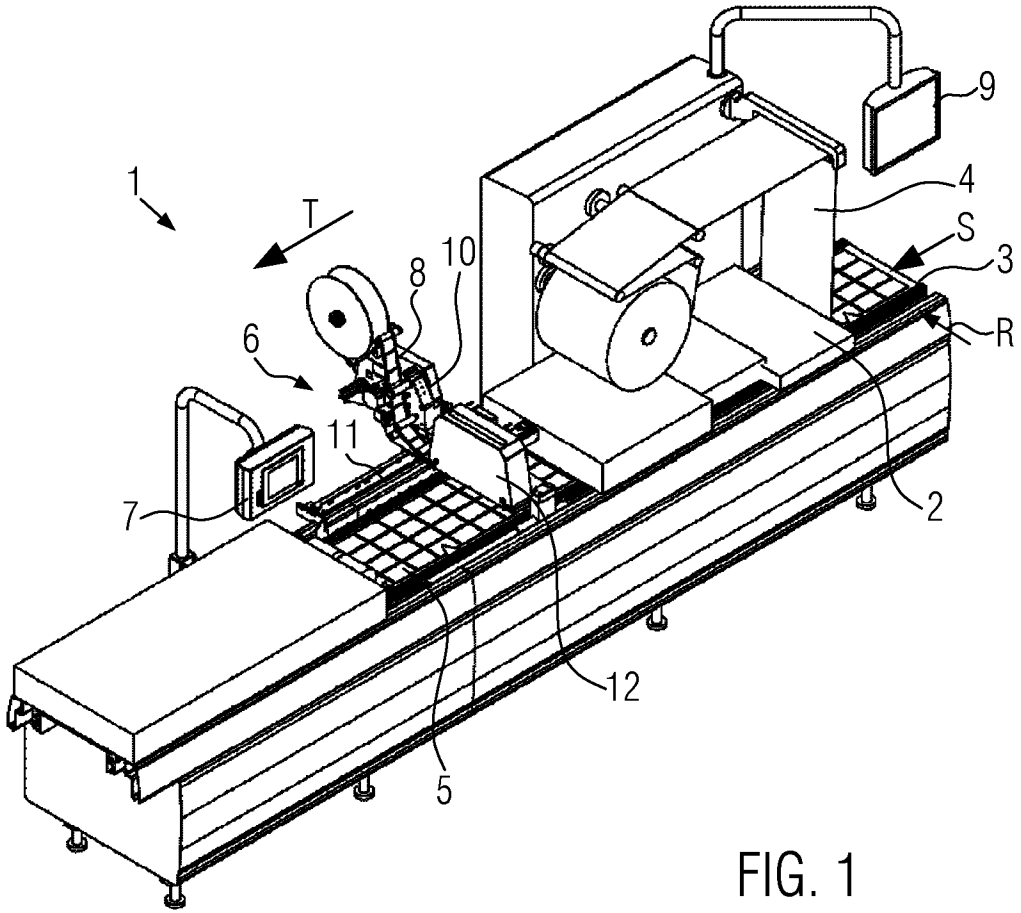
FIG. 1 is a perspective view of one embodiment of a section of a thermoforming packaging machine having a labelling device in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a section of a thermoforming packaging machine 1 with a sealing station 2, into which a bottom film 3 and a lid film 4 are fed to produce packaging 5. In sealing station 2, for example, twelve packages 5, divided into four tracks S and three rows R, are sealed in one work cycle. In transport direction T, a labelling device 6 with a control 7 is arranged downstream sealing station 2 in order to apply labels 8 from above to the lid film 4 on the twelve packs 5 in one working cycle. The control 7 of the labelling device 6 can also be integrated in a control 9 of the thermoforming packaging machine 1. The labelling device 6 has a label dispenser 10, a traversing device 11 and a transmission device 12.

Figure 2:
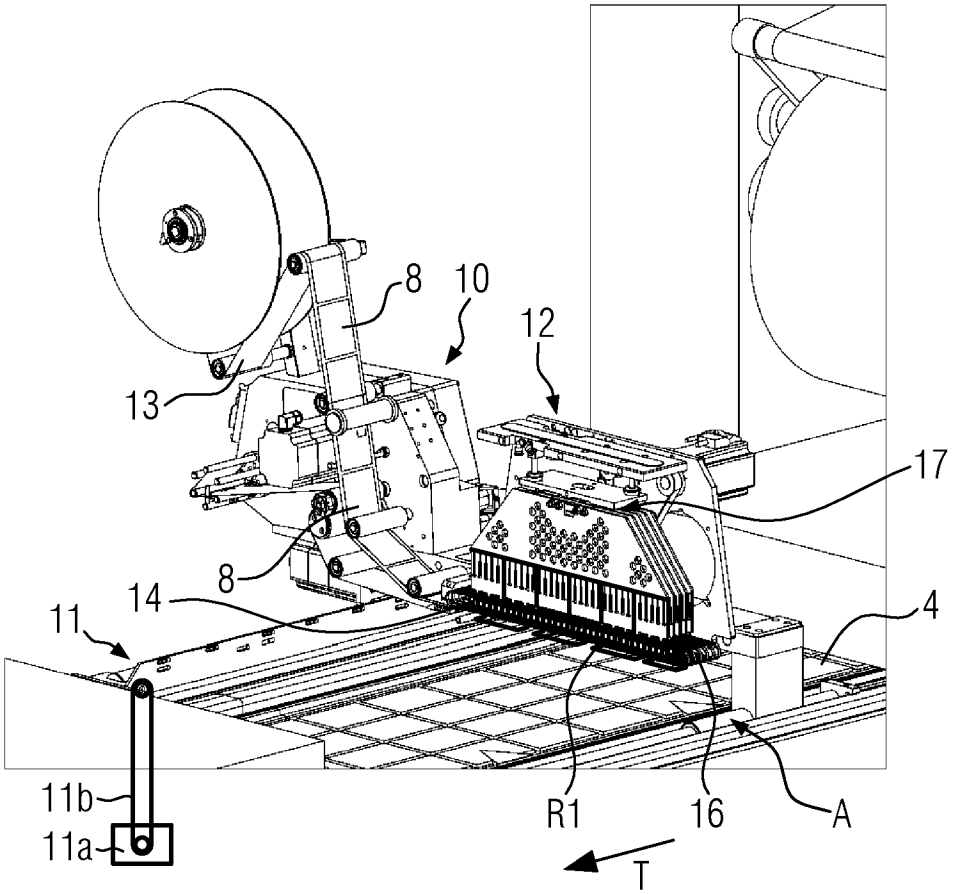
FIG. 2 is a perspective side view of one embodiment of a labelling device in accordance with the teachings of the present disclosure showing the labelling device in a first position.

FIG. 2 shows the label dispenser 10 with a carrier strip 13 for labels 8, wherein the labels 8 are detached from the carrier strip 13 via a dispensing edge 14 and transferred to the transfer device 12. The transfer device 12 is shown without a cover for better illustration. By means of a negative pressure generated by a not shown fan, the labels 8 can be held with their non-adhesive tops on transport belts 16, while a first row R1 of labels 8 with the number of tracks S are picked up by the transfer device 12. During this phase a lifting device 17 of the transfer device 12 is in a receiving position. In order to apply the row R1 of labels 8 downwards to the cover film 4, the traversing device 11 moves the label dispenser 10 with the transfer device 12 in or against the transport direction T to the position in which the row R1 of labels 8 is to be applied from above to the cover film 4. The transfer device 12 is then located above an article web A. The traversing device 11 is driven by a schematically depicted motor 11*a*, for example a servo or stepper motor, and a toothed belt drive 11*b*. However, the transfer device 12 can already be positioned above the article web A of packaging 5, while the first row R1 of labels 8 is picked up.

Figure 3:
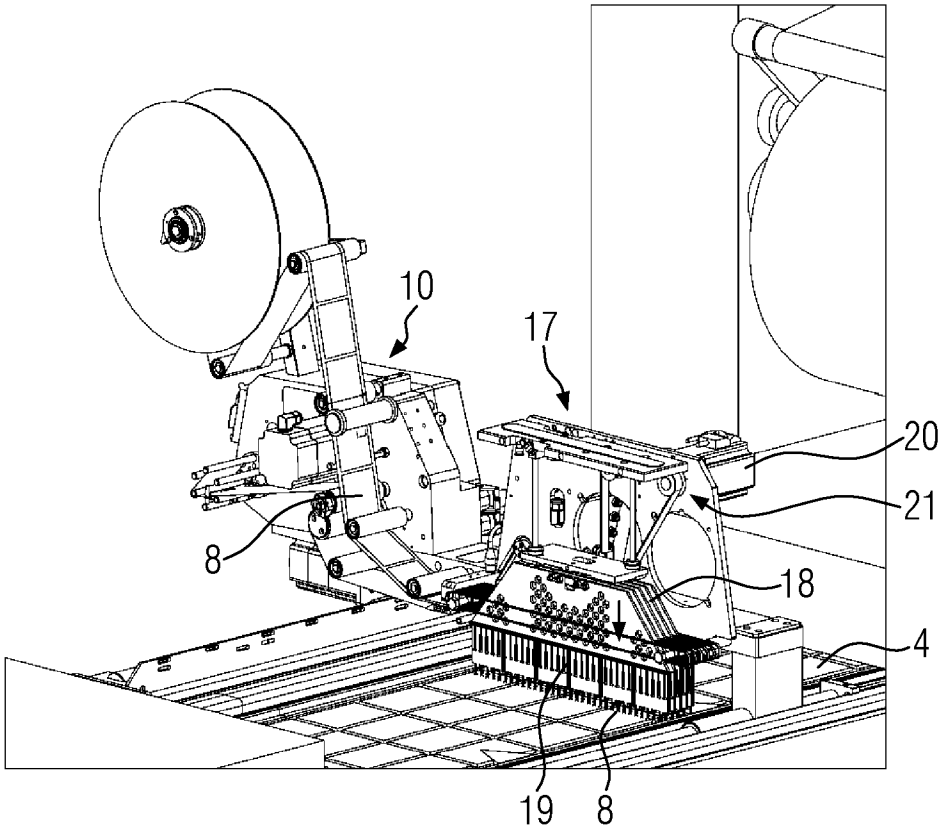
FIG. 3 is the embodiment of the labeling device of FIG. 2 shown in a target position.

FIG. 3 shows the phase in which the lifting device 17, which has a plurality of slide assemblies 18 with spring-loaded pressing elements 19, has been moved downwards to such an extent that the labels 8 are lifted from the transport belts 16 by the pressing elements 19, which are each in the form of slide pins 19*a*, and pressed onto the lid film 4. The slide assemblies 18 are moved to the target position by means of a motor 20 (e.g. by means of a servo motor, a stepper motor or a DC motor) and a belt drive 21. This can be adjusted by the operator so that an optimum and predefined pressure force is generated by the spring-loaded pressing elements 19 to press the labels 8 on.

Figure 4:
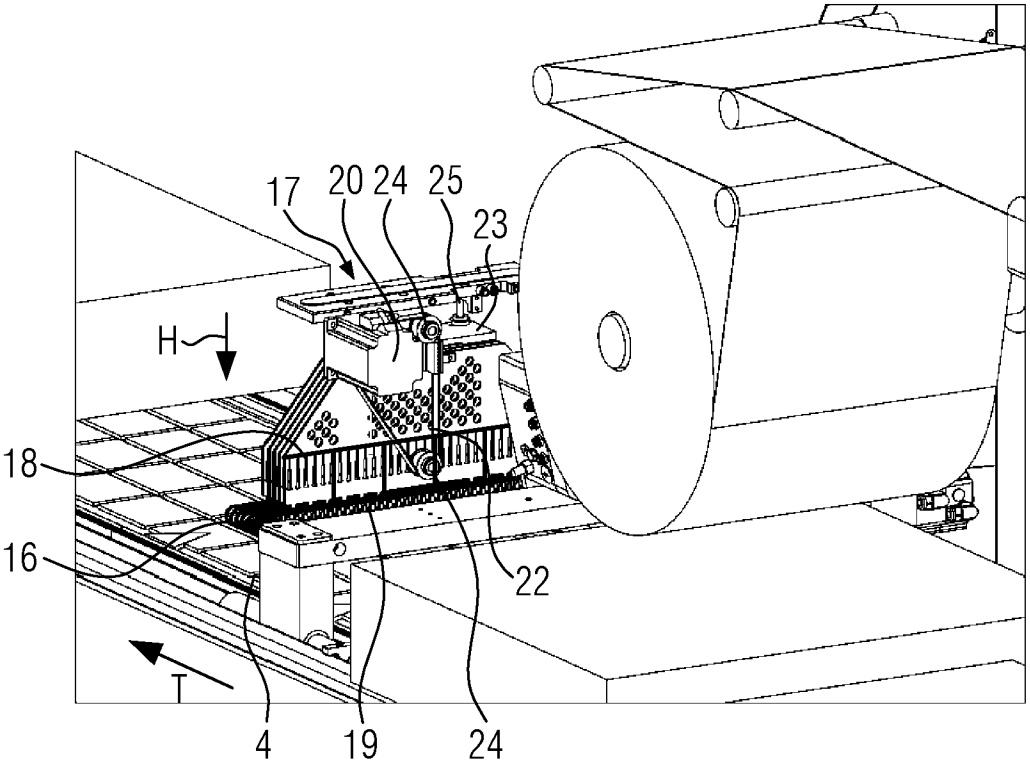
FIG. 4 is a rear perspective view of one embodiment of a labelling device a rear view of the labelling device with lift drive in accordance with the teachings of the present disclosure.

FIG. 4 shows the structure of the lifting device 17 in the view in transport direction T. The motor 20 transmits its rotation and torque to a belt 22 connected to a lifting plate 23. By means of two deflection rollers 24 and guides 25 for the lifting plate 23, the rotational movement of the motor 20 is converted into a vertical movement of the lifting plate 23, whereby the slide assemblies 18 attached to it are shifted to the bottom. The slide assemblies 18 are spaced far enough apart to pass between the transport belts 16 to pick up the labels 8 from the transport belts 16 and apply them to the lid film 4.

Figure 5:
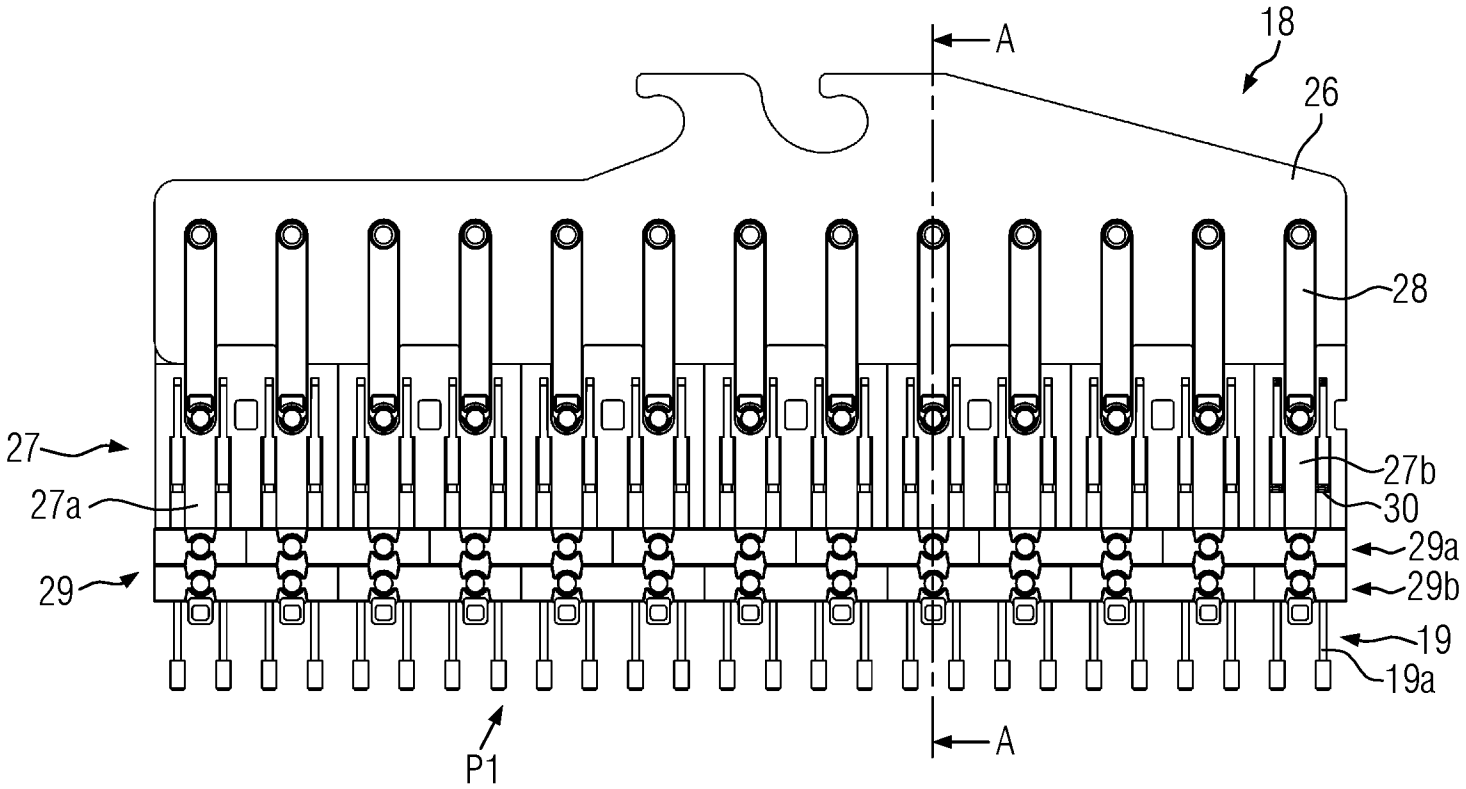
FIG. 5 is a front view of one embodiment of an isolated slide assembly of a labelling device in accordance with the teachings of the present disclosure.

FIG. 5 shows in detail one of the slide assemblies 18 shown in FIG. 4 isolated. The slide assembly 18 has a modular assembly. The slide assembly 18 comprises in particular a base plate 26 and a large number of cassette modules 27 attached to it. The respective cassette modules 27 are attached to the base plate 26 by means of several coupling elements 28. According to FIG. 5, the respective coupling elements 28 are vertically aligned at a distance next to each other.

In FIG. 5, six cassette modules 27*a* are attached to the base plate 26, each of which is configured to accommodate four pressing elements 19. Viewed from the outside right in the image plane, a cassette module 27*b* is attached which is only intended to accommodate two pressing elements 19.

FIG. 5 also shows that the cassette modules 27 attached side by side to the base plate 26 are attached to each other. Connecting the respective cassette modules 27 is achieved by means of an upper row 29*a* of connector elements 29. A lower row 29*b* of connector elements 29 is attached to the respective cassette modules 27 to secure the pressing elements 19 arranged thereon.

In FIG. 5, the respective pressing elements 19 are designed as slide pins 19*a*. The respective slide pins 19*a* are pre-tensioned by means of a spring 30 to the first position P1 shown in FIG. 5. When pressing the labels 8 onto the cover film 4, the respective slide pins 19*a* can be inserted into the cassette module 27 carrying them.

Figure 6:
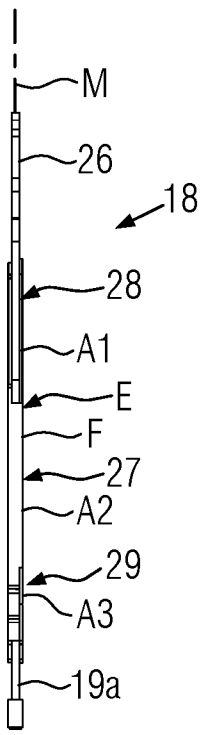
FIG. 6 is a side view of the embodiment of the slide assembly in FIG. 5 viewed in cutting direction A.

FIG. 6 shows the slide assembly 18 shown in FIG. 5 in sectional view in line of sight A. The base plate 26 is assembled in alignment with the respective cassette modules 27 in a module plane M. The coupling elements 28 as well as the respective cassette modules 27 are configured and connected to each other in such a way that they form outer sides A1, A2, whereby the respective outer sides A1, A2 together define a guide level E. FIG. 6 also shows that an outer side A3 of the connector elements 29 lies within the guide level E. The respective outer sides A1, A2, A3 can thus together form an enlarged guide surface F in order to move the slide assembly 18 precisely along the guide level E. This also results in a smooth surface that is particularly suitable for hygienic operation, where impurities are reduced or even non-adherent.

Figure 7:
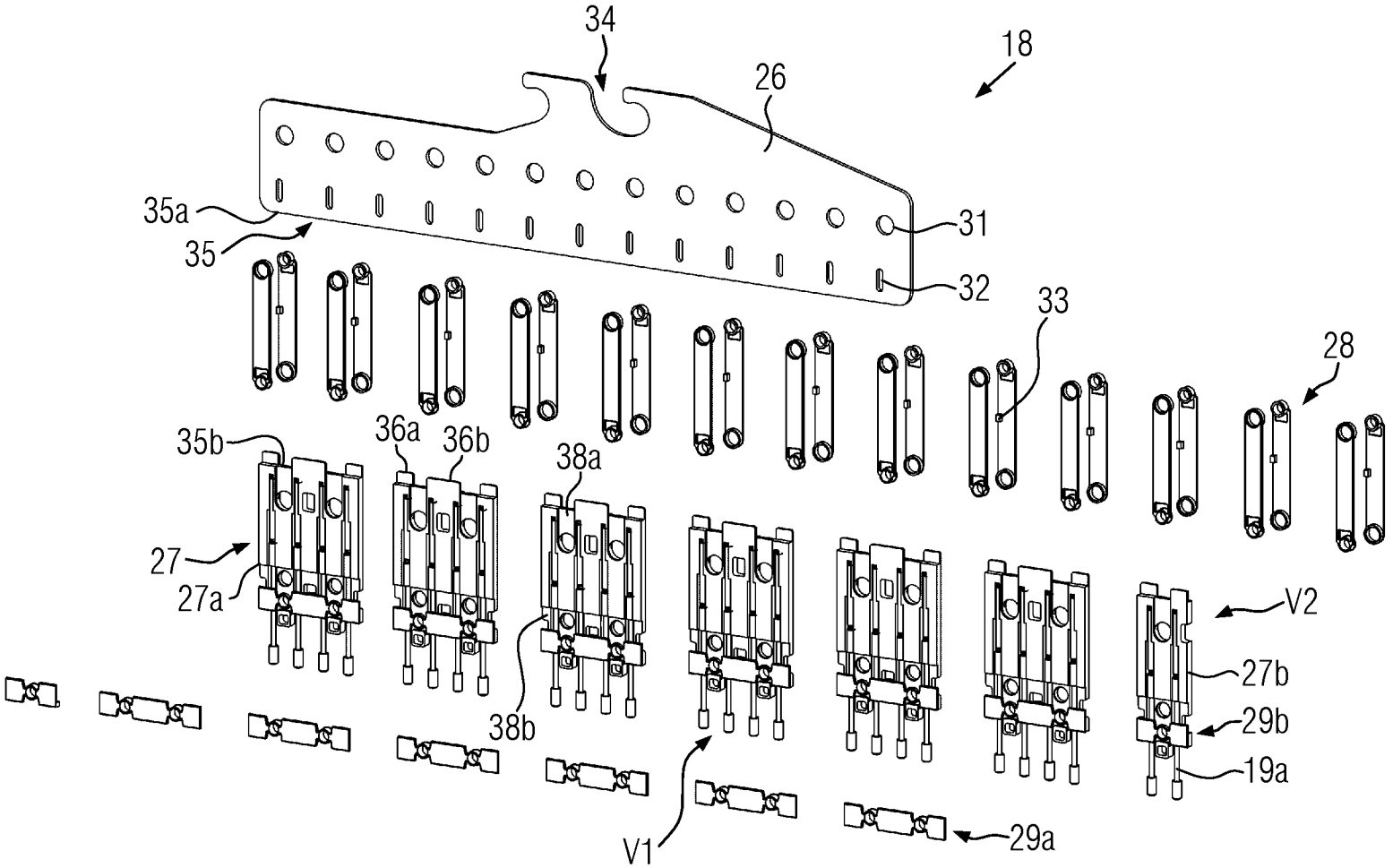
FIG. 7 is an exploded view of the embodiment of the slide assembly shown in FIG. 5.

FIG. 7 shows the slide assembly 18 in an exploded view. The base plate 26 contains a large number of fixing openings 31 to which the coupling elements 28 can be attached. In addition, the base plate 26 has clearances 32 at which sprue points 33 of the coupling elements 28 can engage, whereby the clearances 32 can be used as alignment aids to secure the coupling elements 28 in vertical alignment. Furthermore, the base plate 26 includes a mounting part 34, by means of which the base plate 26 can be fastened to the lifting plate 23.

FIG. 7 further shows an interface 35 for assembling the base plate 26 with the cassette modules 27, wherein the interface 35 is formed from a rectilinear end edge 35*a* of the base plate 26 and a corresponding rectilinear connecting edge 35*b* of the respective cassette modules 27. In the assembled state shown in FIG. 5, the coupling elements 28 hold the end edge 35*a* and the connecting edge 35*b* together so that the respective cassette modules 27 are fixed relative to the base plate 26.

According to FIG. 7, the respective cassette modules 27 comprise retaining projections 36*a*, 36*b* in the area of the connection edge 35*b*, which are provided in such a way that the end edge 35*a* of the base plate 26 can be accommodated between them. The retaining projections 36*a*, 36*b* ensure that the cassette modules 27 remain firmly aligned with the base plate 26 along module level M, even during continuous operation.

The respective cassette modules 27 are equipped with a first and a second receptacle 38*a*, 38*b*. FIG. 7 shows that the coupling elements 28 in the first receptacle 38*a* and the connector elements 29 in the second receptacle 38*b* are attachable.

In FIG. 7, the respective cassette modules 27 are each shown as a pre-assembly module V1, V2, whereby the respective pre-assembly modules V1, V2 are fastened to the base plate 26 in a first assembly step by means of the coupling elements 28 next to each other and are then connected to each other in a second assembly step by means of the connector elements 29*b*, so that a stable bond can be produced for the slide assembly 18 overall.

Figure 8:
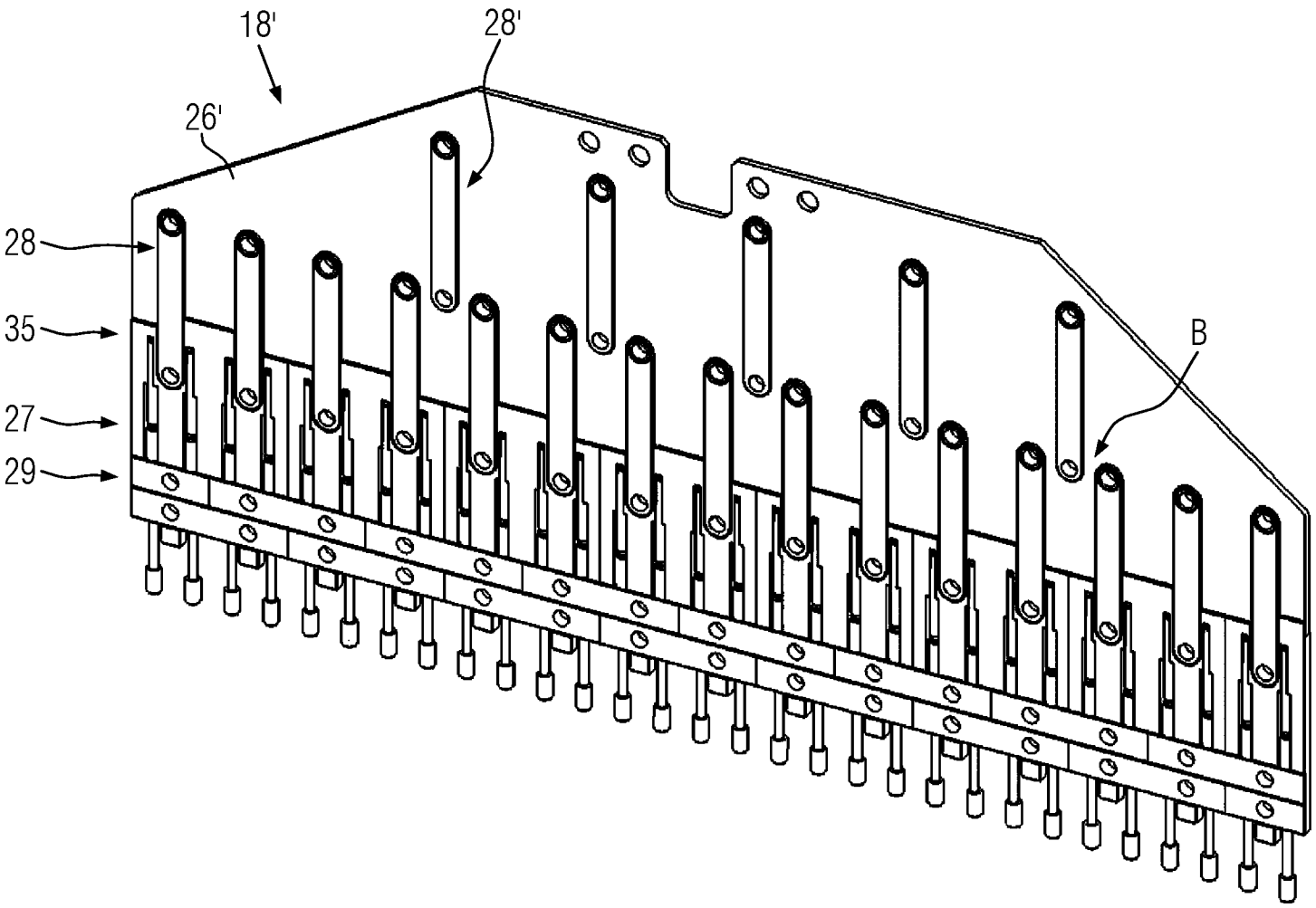
FIG. 8 is a perspective view of one embodiment of a slide assembly in accordance with the teachings of the present disclosure.

FIG. 8 shows a slide assembly 18'. As shown in FIG. 8, a plurality of cassette modules 27' are mounted side by side on a base plate 26' along the defined interface 35 in accordance with the assembly of the slide assembly 18 shown in FIG. 5. In addition to the slide assembly 18 shown in FIG. 5, the slide assembly 18' shown in FIG. 8 includes integrated coupling elements 28' on the base plate 26', which can be used as additional guide means. Together with the formed outer sides A1, A2, A3 of the coupling elements 28, the module cassettes 27 as well as the connector elements 29, the additionally provided coupling elements 28' can further enlarge the guide surface F. For an improved guidance function, the respective coupling elements 28, 28' are partially arranged overlapping in an area B.

Figure 9:
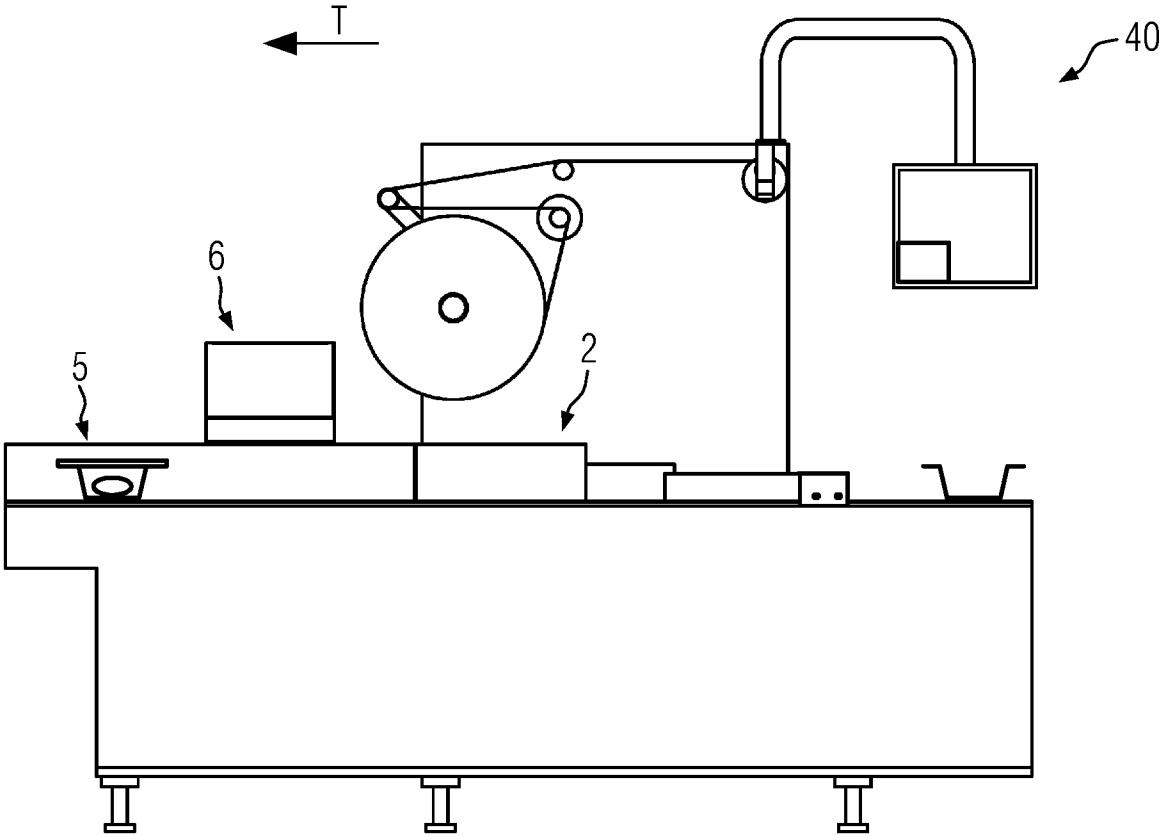
FIG. 9 is a perspective view of one embodiment of a tray sealer including a labelling device in accordance with the teachings of the present disclosure.

According to the schematic illustration in FIG. 9, the labelling device 6 according to the invention can also be used on a tray sealer 40.

In the invention, the respective cassette modules 27 are primarily used as carrier units for the pressing elements 19. Therefore, the base plate 26 as such does not need to be designed to accommodate the respective pressing elements 19 with a plurality of specially designed mounting openings. The cassette modules 27 can be manufactured as injection-molded parts from a cost-effective material and can be manufactured without any problems and without any technical difficulties for mounting and assembling the respective pressing elements 19. For the manufacturing and application process, the combination of the respective modules of the inventive slide assembly 18, 18' results in considerable advantages over the state of the art. In addition, the respective modules of the slide assemblies 18, 18' according to the invention also offer advantages for their storage and can be considered for different applications. In addition, the modular design offers versatile extension options.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A labelling device comprising:

a label dispenser; and a transfer device for transferring a row of labels dispensed to the transfer device to an article web;

wherein the transfer device has a slide assembly mounted thereon in a vertically adjustable manner for pressing the labels onto the article web;

wherein the slide assembly comprises a base plate and a plurality of pressing elements;

wherein the slide assembly further comprises multiple cassette modules detachably connected to the base plate, wherein more than one of the plurality of the pressing elements are arranged on each cassette module;

wherein the base plate, the cassette modules and the plurality of the pressing elements are assembled along a module plane that is oriented in a direction of movement of the plurality of the pressing elements, wherein, when assembled, the base plate and the cassette modules attached to the base plate are in the form of a modular slide plate, wherein the cassette modules are mounted side by side on the base plate and adjacent cassette modules are directly fastened to each other by a connector element.

2. The labelling device according to claim 1, wherein for each cassette module, each of the one or more of the plurality of pressing elements is pre-loaded using a spring into a disengaged first position on the cassette module.

3. The labelling device according to claim 1, wherein each cassette module is coupled to the base plate using a coupling member.

4. The labelling device according to claim 3, wherein each coupling member is dimensioned so as to be insertable for guiding the slide assembly along a guide plane.

5. The labelling device according to claim 4, wherein each cassette module comprises at least one first receptacle that receives a respective coupling member, wherein each coupling member is arranged such that at least one or more portions of an outer side of each cassette module lies within the guide plane.

6. The labelling device according to claim 5, wherein each cassette module comprises at least one second receptacle that receives at least one connector element which secures a respective pressing element to the cassette module.

7. The labelling device according to claim 1, wherein each cassette module is formed from plastic.

8. The labelling device according to claim 7, wherein each cassette module is an injection-moulded part.

9. The labelling device according to claim 1, wherein each cassette module is configured for receiving two or four of the plurality of pressing elements.

10. The labelling device according to claim 1, wherein each cassette module is a pre-assembly module.

11. A packaging machine in the form of a thermoforming packaging machine or a tray sealer comprising the labelling device according to claim 1.

12. The labelling device according to claim 1, wherein the base plate comprises a flat plate having a rectilinear end edge, and each cassette module has a corresponding rectilinear connecting edge, and wherein the slide assembly further comprises one or more coupling elements to hold the end edge and the connecting edge of each cassette module together so that each cassette module is fixed relative to the base plate.

13. The labelling device according to claim 12, wherein each cassette module comprises multiple retaining projections in an area of the connecting edge and configured to accommodate the base plate therebetween.

14. The labelling device according to claim 12, wherein the base plate defines multiple fixing openings, and the one or more coupling elements comprise multiple coupling elements that cooperate with the fixing openings to attach the cassette modules to the base plate.

15. The labelling device according to claim 14, wherein the base plate defines multiple clearances, and each coupling element has a projection that is engageable with a clearance to secure the coupling element in a vertical orientation.

16. A labelling device comprising:

a label dispenser; and a transfer device for transferring a row of labels dispensed to the transfer device to an article web;

wherein the transfer device has a slide assembly mounted thereon in a vertically adjustable manner for pressing the labels onto the article web;

wherein the slide assembly comprises a base plate and a plurality of pressing elements;

wherein the slide assembly further comprises a plurality of cassette modules mounted side by side on the base plate, each of the plurality of cassette modules is attached to the base plate with a coupling member, each coupling member has one end attached to the base plate and an opposite end attached to a respective one of the plurality of cassette modules, and more than one of the plurality of the pressing elements are arranged on each cassette module;

wherein the base plate, the plurality of cassette modules and the plurality of the pressing elements are assembled along a module plane that is oriented in a direction of movement of the plurality of the pressing elements, and wherein, when assembled, the base plate and the plurality of cassette modules mounted on the base plate are in the form of a modular slide plate.

17. A labelling device comprising:

a label dispenser; and a transfer device for transferring a row of labels dispensed to the transfer device to an article web;

wherein the transfer device has a slide assembly mounted thereon in a vertically adjustable manner for pressing the labels onto the article web;

wherein the slide assembly comprises a base plate and a plurality of pressing elements;

wherein the slide assembly further comprises at least one cassette module assembled with the base plate, each of the at least one cassette module is attached to the base plate using a coupling member, each coupling member has one end attached to the base plate and an opposite end attached to a respective one of the at least one cassette module, and one or more of the plurality of the pressing elements are arranged on each of the at least one cassette module; and wherein the base plate, the at least one cassette module and the plurality of the pressing elements are assembled along a module plane that is oriented in a direction of movement of the plurality of the pressing elements.

18. The labelling device according to claim 17, wherein the base plate comprises coated hard paper including a paper carrier material and a resin binding agent, and the at least one cassette module comprises a polyamide or polyoxymethylene.

* * * * *